United States Patent [19]

Hutchinson

[11] Patent Number: 4,497,125

[45] Date of Patent: Feb. 5, 1985

[54] WALL DISPLAY DEVICE

[76] Inventor: Daniel M. Hutchinson, 740 Woodland Ave., Mantua, N.J. 08051

[21] Appl. No.: 517,669

[22] Filed: Jul. 27, 1983

[51] Int. Cl.[3] ..... G09F 3/18

[52] U.S. Cl. ..... 40/10 R; 40/124; 40/124.2; 40/605; 248/488

[58] Field of Search ..... 40/124.2, 124.4, 124.1, 40/605, 10 R; 46/31, 30; 52/509; 248/488

[56] References Cited

U.S. PATENT DOCUMENTS 2,513,239 6/1950 Hatchett ..... 40/19.5

3,913,289 10/1975 Recker ..... 46/31

4,003,470 1/1977 Lagorio et al. ..... 40/124.2

*Primary Examiner*—Gene Mancene

*Assistant Examiner*—Cary E. Stone

*Attorney, Agent, or Firm*—Thomas A. Lennox

[57] ABSTRACT

A wall display device, particularly suitable for displaying record albums including a plurality of blocks, one for each corner of the album having upper vertical corner channels to hold the bottom corners of the album and vertical side channels to hold the upper corners of the album where each block can support the corners of four different albums.

13 Claims, 7 Drawing Figures

Fig. 3
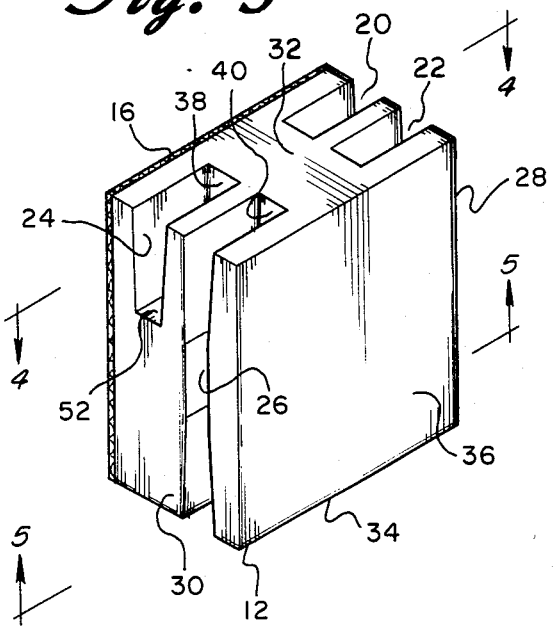
Fig. 4
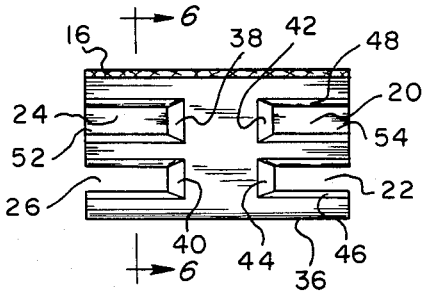
Fig. 5
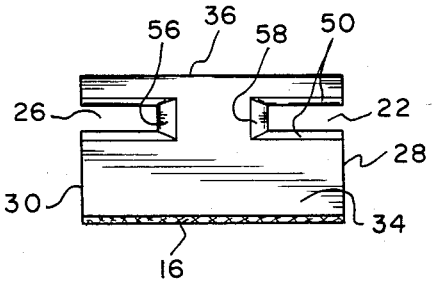
Fig. 6
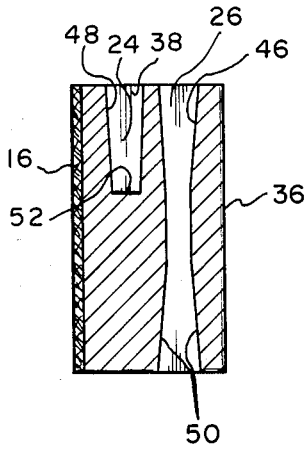
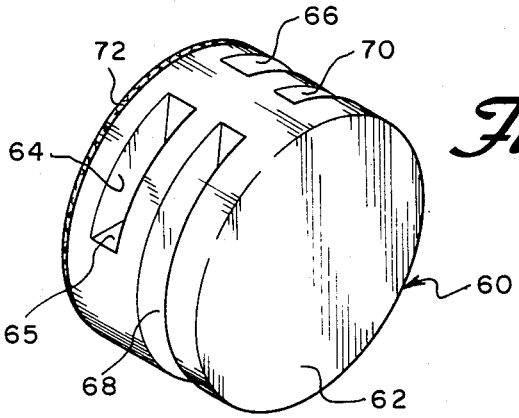
Fig. 7

WALL DISPLAY DEVICE

BACKGROUND OF THE INVENTION

This invention relates to a wall display device and in particular wall display holders that support and hold panels on a wall for display purposes.

This invention provides a means for supporting and holding panels on a pre-existing wall for the purposes of displaying the color, design or picture of the panel. A particularly effective use of the display device of this invention is to display, store and have ready for use record albums on a wall either in a residence or in a store selling record albums. The artwork on many record albums is of such quality as to invite display. It is also of interest to hold and support the record albums in such a fashion as to avoid damage. In addition, it is desirable to have the record albums immediately available for play at any time without recourse to a cabinet or file. However, this invention is not strictly limited to this use as, for example, photographs are commonly fixed to some type of board or foam back support which will allow their display on the device of this invention. In addition, color panels and design panels may be created or included with the device of this invention which allows the homeowner to create designs, murals and color combinations which may be varied to suit any change of taste or season. The only limitation on the panels is that they be sufficiently rigid to support their own weight on edge. For the purposes of this specification, the term "semi-rigid" is used, to denote that physical quality.

Phonograph album display devices have been described in U.S. Pat. Nos. 4,258,488 to Schienbein, 4,041,630 to Holbrook, and in 3,676,942 to Elrod. Other mounting and frames are described in 2,513,239 to Hatchett, 1,625,724 to F. Huszti-Horvath, 2,833,071 to Glass, 3,853,226 to Hine, and 4,213,259 to Coda. None of these devices offer the utility and satisfy the needs of the uses described above nor satisfy the objects or include the elements of the invention described herein below.

SUMMARY OF THE INVENTION

An object of the invention is to provide a wall display device capable of supporting and holding rigid and semi-rigid panels on a wall.

A particular object of this invention is to provide a display device which allows essentially all of the surface of a panel to be displayed, but yet holds the panel firmly in position and yet ready for removal and reinsertion without damage to the panel.

A particular object of this invention is to provide a wall display device capable of holding phonograph records in albums and thereby provide a decorative scheme for the wall, a storage capacity for the albums and a ready availability for play.

A particular object of this invention is to provide a holding device which supports the lower edges of a panel and also holds the upper edges of the panel securely in a vertical position.

It is another object of this invention to provide a single block element which when located near the corners of panels to be held on a wall, will have multi-purpose effect in holding not only the panels above the block in position, but at the same time, hold the panels below the block in position.

It is a particular object of this invention to provide blocks that will support panels on the walls yet allow a single panel to be removed and reinserted without affecting adjacent panels in any way.

It is a particular object of this invention to provide a single block that will singularly or in combination hold any of the four corners of the panel on the wall and yet allow any panel to be disengaged and re-engaged at any time without in any way damaging the panel.

It is an additional object of this invention to provide a commercial storage and display system wherein a plurality of blocks may be stacked horizontally and attached to the wall to hold a number of same albums in front of each other.

The support device for holding on a wall semi-rigid panels at their corners includes a plurality of blocks each having an attachment means for firm attachment of each block to a wall. Each block has a front face, two side faces, a top face and a bottom face. If the corners of the block are removed such as when the block is in the shape of a cylinder, the faces are considered extending in shadow form so as to describe the following channels cut out of the block. Each block has two vertical channels, each opening on opposite side faces with each channel extending through the bottom face of a width to receive the thickness of the semi-rigid panels to be held. Each block also has two vertical corner channels both opening through the top face and one of them opening through one side face and the other opening through the opposite side face with each corner channel terminating at a bottom stop in the downwardly direction at a depth less than the vertical depth of the vertical channels as measured from the bottom face. The corner channels are of a width to receive a corner of the panels.

Throughout the specification and claims the term "block" is referred to. This term is not intended to limit the scope of the invention as to shape, material, internal structure or the like. For example, it should be clear from the description of the preferred embodiments that while the block may take the shape of a cube, it may just as easily be a cylinder or any other geometric shape so long as the shape allows sufficient volume and configuration for the channels to allow engagement of the corners of the panels in the block. While the blocks illustrated in the description of preferred embodiments are solid, it is recognized that they may be constructed in a hollow form such that all the surfaces and bearing points are available for support, the internal structure is void. In addition, the material is not critical to the invention and may be wood, polymeric plastic, metal, cellular foam or any other material found suitable in structural form and durability.

BRIEF DESCRIPTION OF THE DRAWINGS

FIG. 3 is a perspective view of a support block of the present invention.

FIG. 4 is a top view of the support block of FIG. 3.

FIG. 5 is a bottom view of the support block of FIG. 3.

FIG. 6 is a cross-sectional view taken along lines 66 of FIG. 4 illustrating the internal construction of the support block of FIG. 3.

FIG. 7 is a perspective view of a second embodiment of a support block of the invention.

DESCRIPTION OF PREFERRED EMBODIMENTS

Figure 1:
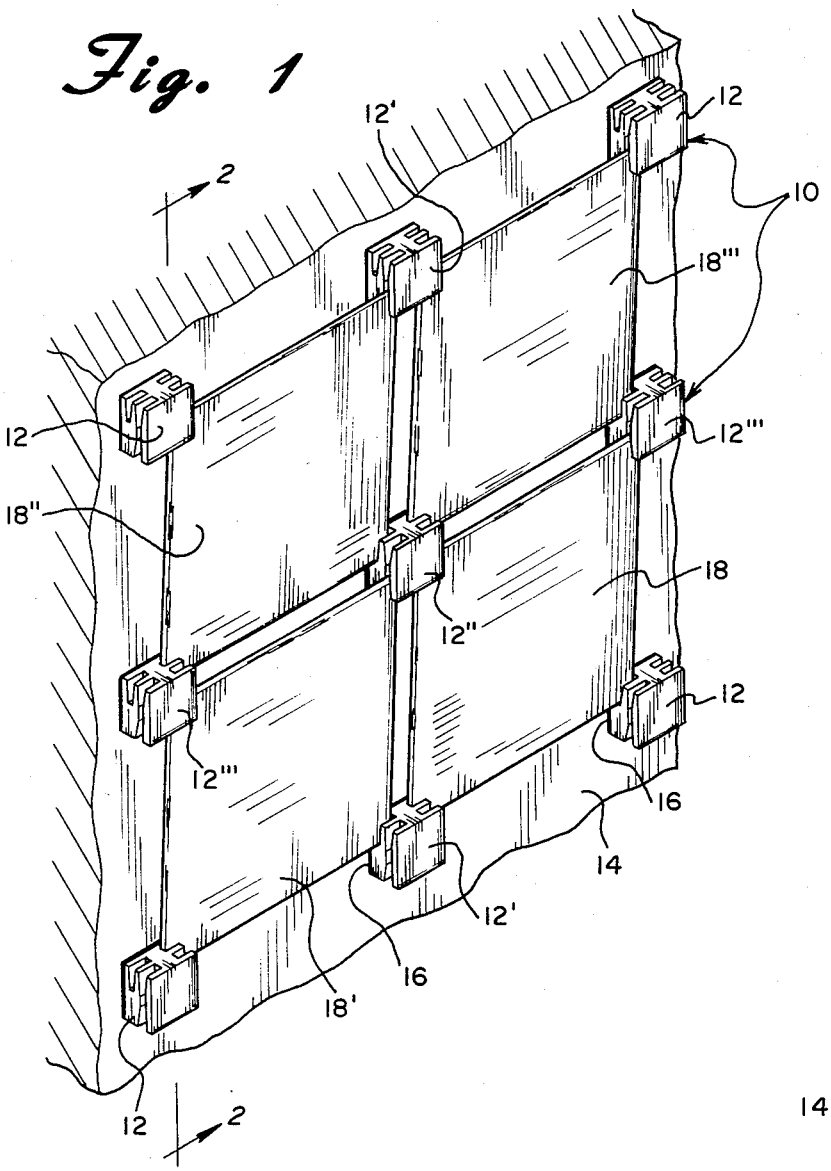
FIG. 1 is a perspective view of the wall display device of this invention illustrating the device holding phonograph record album covers to the wall in a typical combination.
Figure 2:
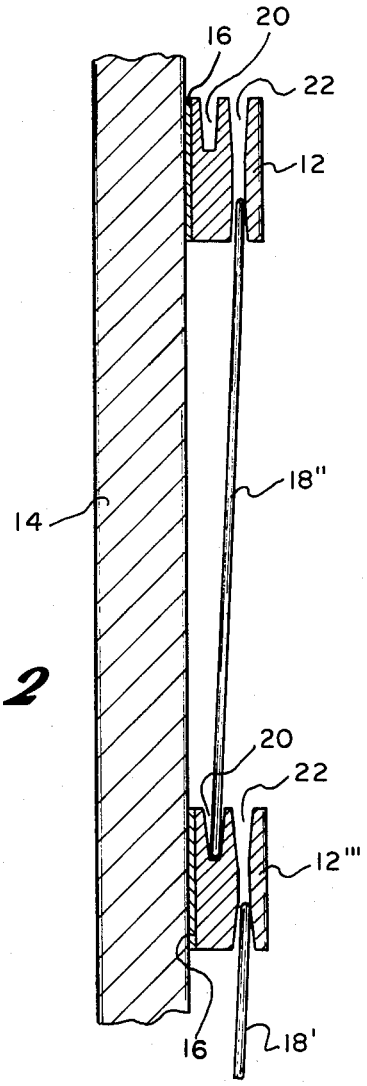
FIG. 2 is a cross-sectional view taken along lines 22 of FIG. 1 illustrating a section of the display device showing two display support blocks holding albums in place.

In FIG. 1, of the wall display device system 10 of this invention is pictured. Individual support blocks 12 are adhesively attached through contact adhesive 16 and positioned on wall 14 to receive the corners of record albums 18 through 18'''. The pattern of attachment of blocks 12 through 12''' may vary widely and need not be in a regular pattern. So long as four support blocks are located to receive an album, it is not necessary that the blocks be in a checkerboard pattern but are left to the artistic temperament of the person decorating the wall. In this simple display pictured in FIG. 1, block 12 supports from below and holds the right lower corner of album 18, while its opposite number support block 12' supports from below and holds the lower left corner of album 18. In order to prevent the album from slipping out, support blocks 12'' and 12''' are located to receive the upper corners of album 18, thereby firmly holding it in place and essentially preventing any chance of falling. The support device system of this invention has the advantage that the support blocks provide multiple functions. Thus, while support blocks 12'' and 12''' are holding the upper corners of album 18, they are at the same time available for lower support and holding the lower corners of album 18''' and so on in a vertical direction. Likewise, in a horizontal direction, support block 12' while continuing to hold the lower left corner of album 18, also supports from below and holds the lower right corner of album 18'. Similarly, support block 12'' also supports the upper right corner of album 18' and so on in a horizontal direction. Thus, each support block may be supporting from one to four albums at the same time. The cross-sectional view illustrated in FIG. 2 taken along lines 2—2 of FIG. 1 illustrates how each album is held, inserted and removed from the support blocks 12. In this cross section, album 18'' is supported from the bottom by support block 12''' and held at the top by support block 12. The left lower corner of album cover 18'' rests in right corner channel 20 of support block 12'''. The depth of these corner channels may vary, but it is preferred that the depth be about one quarter to about one half of the total vertical dimension of the block. The upper left corner of album cover 18'' is engaged in right side channel 22 of support block 12. The album covers are engaged into support device 10 by first inserting the upper corners into the respective side channels of two adjacent support blocks. In this case, the upper left corner of album 18'' is inserted into the bottom face entrance of right channel 22 and eased upwardly until the lower edge of the album cover is free of the top surface of the next lower support block, in this case, block 12'''. The lower edge of the album cover is then swung toward the wall and allowed to drop into the respective corner channels; in this case, the left lower corner of the album rests in right corner channel 20 of support block 12'''. The vertical distance between blocks 12 and 12''' is easily chosen such that when the album cover comes to rest at the base of channel 20, the upper corners are still engaged in side channel 22, thus firmly holding the album in place until it is ready for removal. When the album is to be removed, it is a simple task to raise the album cover in channel 22 until the bottom clears the corner channels below, the bottom of the album is pulled toward the person, allowed to drop, and the album is free of the support device. As is shown in FIG. 2, support block 12''' is providing a dual purpose in that the upper left corner of album cover 18' is also engaged in right side channel 22 of support blcok 12'''. Details of the support blocks 12 are provided in various views of FIG. 3 through FIG. 6. In the perspective view of FIG. 3, left corner channel 24 is shown as a void in the upper left corner of block 12 essentially identical to right corner channel 20. The bottom base 52 of corner channel 24 is shown where the right bottom corner of the album may rest. Face 38 as well as the other vertical walls of the channels are slightly angled outwardly from the center line of the channel to open the channel to facilitate insertion of the corners of the albums. The slope of face 38 of a shape the width of the channel by the depth of the channel is particularly useful to bring the albums into vertical alignment with each other on the wall. Left side channel 26 opens to the entire left side face 30 of block 12 and is opened to essentially its full depth through upper face 32 and bottom face 34. Again, the walls are angled to open up the channel to aid in insertion of the corners of the album covers from any direction. For example, vertical internal wall 40 represents essentially the bottom of channel 26 and on the top is angled slightly away from the channel void in order to facilitate entrance from above of the album cover, although the album cover will generally be inserted from below into the side channels. Adhesive 16 is a double faced foam attachment common to permanent wall attachments. Right side channel 22 opens the entire vertical length of right face 28 and opens to its entire depth through top face 32 and lower face 34. In this embodiment, front face 36 is square, but, as will be shown later in FIG. 7, this shape is not critical to the invention. Further, this front face may contain decoration of any color, design or symbol, such as a miniature record.

FIG. 4 is a top view looking downwardly on block 12 showing the position of left corner channel 24 and right corner channel 20, each terminating in bases 52 and 54 respectively. As shown in this figure, essentially vertical wall 42 of corner channel 20 is angled outwardly from the top to open the channel slightly in the same fashion as is wall 38. Left side channel 26 is identical to that of right side channel 22 with vertical bottom walls 40 and 44 angling outwardly from the channel to open up the edges slightly. As will be seen in this drawing, although not individually numbered, all side walls of the channel such as side wall 48 are angled outwardly to open up the outside surface edges of the channel where the album covers are inserted. For clarification purposes, each one of these walls is not numbered and called out, although side walls 46 of the side channel 22 is illustrative.

In FIG. 5, a bottom view of block 12, it is further illustrated that corner channels 24 and 20 do not extend through the bottom face 34. Side channels 26 and 28 extend through the bottom face and all the way through the top face of block 12 and through the entire length of side faces 30 and 28. Again, all of the side walls of the channels angle outwardly to facilitate insertion of the albums. However, the bottom walls 56 and 58 of channels 26 and 22 respectively are somewhat more important as they engage the corners of the albums and tend to center the albums in position. Side walls 50 are illustrative of the other internal side walls of the channels and are angled outwardly to facilitate the opening.

In FIG. 6, a cross-sectional view taken along lines 6—6 of FIG. 4 shows the angles involved. Left corner channel 24 is shown terminating at the depth of bottom 52 and opening outwardly to the top with slightly angled walls 48. Likewise, left side channel 26 is angled outwardly at the outside faces along walls 46 and 50.

In FIG. 7, a different embodiment of the invention is illustrated using a circular block 60 generally in the form of a cylinder having front face 62. While it is not as easy to picture, the top, side and bottom faces of this block, the channels pass through these areas in essentially the same fashion as in block 12. Left corner channel 64 opens upwardly and to the left side of the block and terminates in bottom 65. The corner channel 64 is equipped to receive the bottom right corner of the album. Similarly, right corner channel 66 is cut in the same fashion as corner channel 20 to receive the lower left corner of the album. Left side channels 68 and right side channel 70 are cut in the same fashion as channels 26 and 22 of block 12 and serve the same purpose as engaging the upper corners of the albums. Block 60 is attached to the wall through adhesive 72.

The simplest and most basic embodiment of the invention is a block which has essentially four corner channels cut from it. The upper corner channels open to the top face and to one of the side faces. The depth is chosen less than one half of the total vertical dimension of the block. The lower corner channels open to the bottom face and to one of the side faces. The vertical depth of the bottom channels is more than one half of the total vertical dimension of the block. In this embodiment, the vertical depth of the bottom corner channels is critical to the extent that there is sufficient distance allowed to raise the panel within the channel sufficient to clear the upper edge of blocks supporting the panel from below. Positioning of the blocks is more critical, and if the positioning of the four blocks at each corner of the panel, particularly in the vertical spacing, the depth of the channels in the block are not critical. The preferred embodiments above allow for more leeway in the vertical positioning of the blocks. If a vertical cross section is taken parallel to a side face positioned horizontally close to that side face, the overall cross section is in the general shape of a block "H." The bridge of the "H" may be higher than the middle, but it may be closer to the middle. If a vertical cross-sectional view is taken parallel to the side face, but in the center of the block, the cross section is essentially a solid block as that cross section is passing through the vertical walls separating the four corner channels.

Packaging of the wall display of this invention is planned to fit four blocks on the corners of a sample panel and holding the blocks in that corner position with transparent plastic such as a shrink wrap. Directions for installation may be included on the sample panel, the sample panel can be used as a templet for positioning of the blocks on the wall, or the templet may include a color or design so that it may be used as a filler or as the wall design itself. One or more panels may be provided in the package.

A preferred form of the support blocks is where the vertical depth of each corner channel is about one quarter to about one half the distance between the top face and the bottom face. It is also preferred that each corner channel is formed of a width leaving an internal vertical wall facing a side face in the shape of the channel width by the vertical depth of the channel, the wall being sloped slightly away from the side surface to which the corner channel opens. It is preferred that the vertical channels open up the entire vertical height of the side face and open the top face to the depth of the channel.

While this invention has been described with reference to the specific embodiments disclosed herein, it is not confined to the details set forth and the patent is intended to include modifications and changes which may come within and extend from the following claims.

I claim:

1. A support device for holding on a wall semi-rigid panels at their corners comprising:

a plurality of blocks each having an attachment means for firm attachment of each block to a wall, wherein each block has a front face, two side faces, a top face and a bottom face, and wherein each block has two vertical channels each opening on opposite side faces with each channel extending through the bottom face of a width to receive the thickness of the semi-rigid panels to be held, and wherein each block has two vertical corner channels both opening through the top face and one of them opening through one side face and the other opening through the opposite side face with each corner channel terminating at a bottom stop in the downwardly direction at a depth less than the vertical depth of the vertical channels from the bottom face, the corner channels being of a width to receive a corner of the panels.

2. The support device of claim 1 wherein the front face is square.

3. The support device of claim 1 wherein the front face is round.

4. The support device of claim 1 wherein the attachment means is a contact adhesive.

5. The support device of claim 1 wherein the vertical depth of each corner channel is about one quarter to about one half the distance between the top face to the bottom face.

6. The support device of claim 1 wherein the vertical channels open up the entire vertical height of the side face and open the top face to the depth of the channel.

7. The support device of claim 6, wherein the vertical channels are offset horizontally from the corner channels toward the front face.

8. The support device of claim 1 wherein the horizontal depth of the vertical channels is about one quarter to about one half the distance between the side faces.

9. The support device of claim 1 wherein the attachment means is capable of attaching a support device on the front face of a second support device.

10. The support device of claim 1 wherein the vertical depth of the corner channels is equal to the horizontal depth of the vertical channels.

11. The support device of claim 10 wherein the horizontal width and the vertical height of the front face are equal and the vertical depth of the corner channels and the horizontal depth of the vertical channels are each equal to about one third of the height or width of the front face.

12. The support device of claim 1 wherein all of the internal walls of the channels are angled slightly outwardly to open up the channels to form a wedge shaped opening of the channels toward the top and bottom faces.

13. The support device of claim 1 wherein each corner channel includes an essentially vertical side wall at an interior end of the channel away from the side face to which the corner channel opens, wherein that side wall slopes outwardly from the channel to the top face.

* * * * *